United States Patent [19]

LoMaglio

[11] Patent Number: 4,949,403

[45] Date of Patent: Aug. 21, 1990

[54] AUTOMATIC DISPENSER FOR FLUSH TANKS

[75] Inventor: Lewis C. LoMaglio, Lancaster, Ohio

[73] Assignee: Anchor Hocking Corporation, Lancaster, Ohio

[21] Appl. No.: 259,990

[22] Filed: Oct. 19, 1988

[51] Int. Cl.[5] ..... E03D 9/03

[52] U.S. Cl. ..... 4/228

[58] Field of Search ..... 4/227, 228

[56] References Cited

U.S. PATENT DOCUMENTS 3,698,021 10/1972 Mack et al. ..... 4/227
3,766,570 10/1973 Finneran ..... 4/228
3,778,850 12/1973 Bryan ..... 4/227
3,874,007 4/1975 Dolan ..... 4/228
4,036,407 7/1977 Slone ..... 4/228 X

FOREIGN PATENT DOCUMENTS 3605890 8/1986 Fed. Rep. of Germany ..... 4/228

*Primary Examiner*—Charles E. Phillips
*Attorney, Agent, or Firm*—Wood, Herron & Evans

[57] ABSTRACT

A packaged dispenser for discharging metered amounts of liquid into a flush tank controlled by the rise and fall of the tank liquid. A container has a screw cap which has internal cooperable screw threads and also has cap positioning means for controlling the position of the unthreaded cap.

6 Claims, 2 Drawing Sheets

AUTOMATIC DISPENSER FOR FLUSH TANKS

BACKGROUND OF THE INVENTION

This invention relates to liquid dispensing means, and more particularly to dispensers for discharging liquid into a flush tank in response to the change of the liquid level therein.

An object of the invention is to provide a liquid dispenser which comprises an open tapered unitary cap that is normally held captive on the container neck and that acts both as a sealing closure for the container during storage and shipping, and as a metering and float valve to dispense liquid into a flush tank in response to the rise and fall of tank fluid. The above object is accomplished by a novel combination of container having a neck portion provided with external screw threads and, spaced therefrom, a pair of separated annular beads disposed closely adjacent the container body.

The cap when applied to the inverted container suspended in a flush tank is a float valve which, in its lowered position, permits a predetermined quantity or charge of liquid from the container to flow into a recessed portion of the cap. As the cap is urged to its raised position by the rising tank liquid, the charge therein is displaced and flows into the tank. In the fully raised position of the cap, the captivating bead is urged by buoyant force against the innermost neck bead of the container and thus provides a satisfactory seal for the container until the next succeeding tank cycle.

BRIEF DESCRIPTION OF THE DRAWINGS

A preferred embodiment of the invention has been chosen for purposes of illustration and description and is shown in the accompanying drawings, forming a part of the specification wherein.

DESCRIPTION OF THE PREFERRED EMBODIMENT

Figure 1:
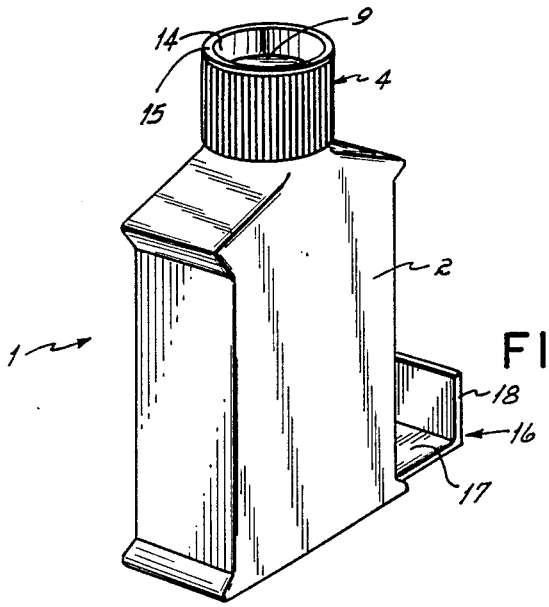
FIG. 1 is a perspective view of the sealed liquid dispenser of the present invention.

Referring first to FIG. 1 there is illustrated a liquid dispenser 1 for flush tanks comprising a container 2 with a screw cap 4. The neck 5 (FIG. 2) communicates with the interior of the container 2, and has external screw threads 6. The screw cap 4 has internal screw threads 7 which engage the external threads 6 of the neck portion 5.

Figure 2:
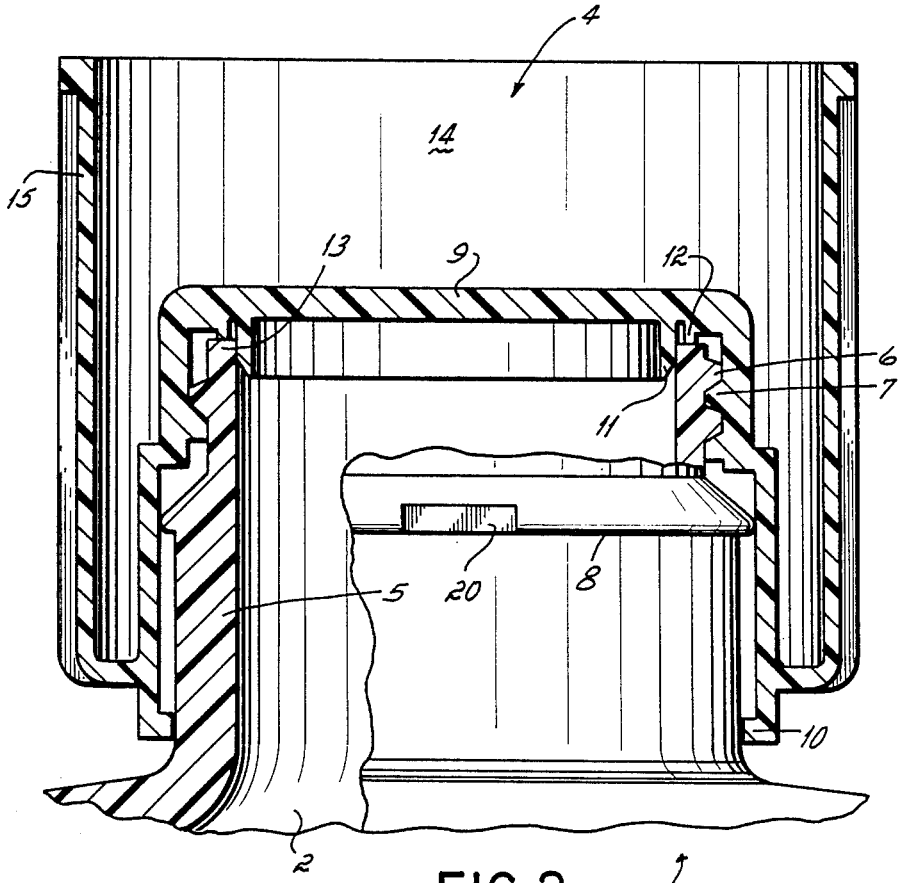
FIG. 2 is a fragmentary vertical sectional view of the dispenser illustrating the threaded screw cap engaging the threads on the container neck.
Figure 5:
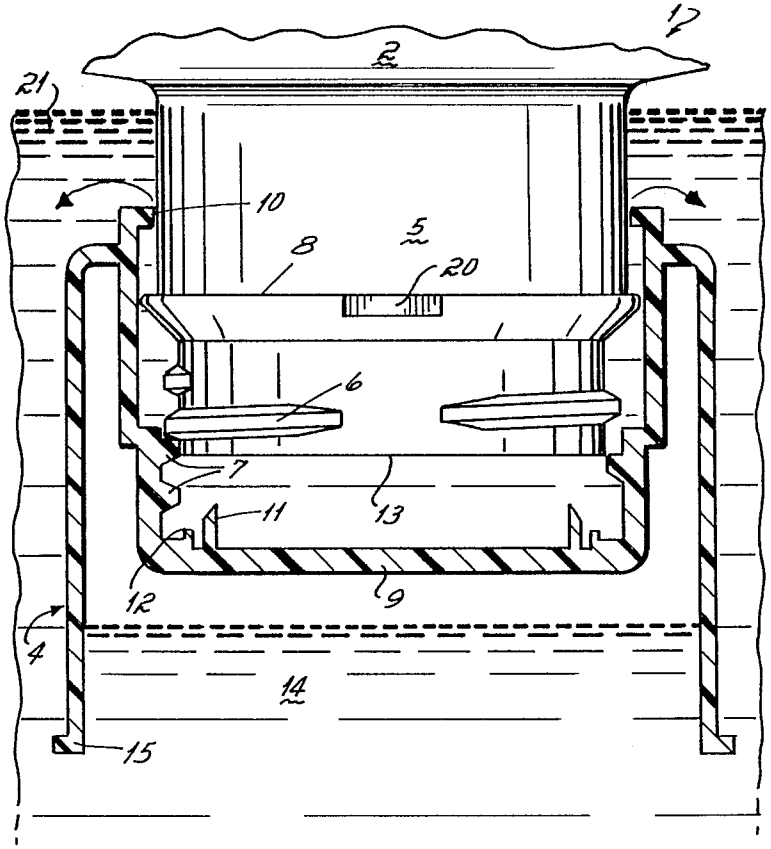
FIG. 5 is a vertical sectional view of the threaded screw cap in its raised position.
Figure 4:
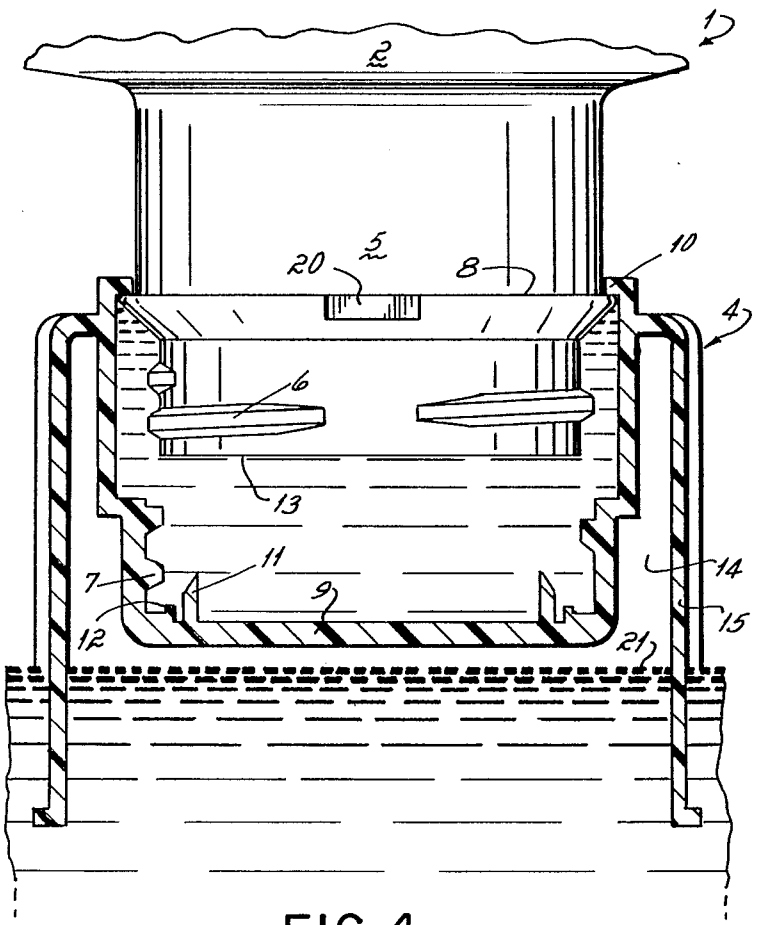
FIG. 4 is a vertical sectional view illustrating the cap in its lowered position, wherein the threads thereof are disengaged from the container neck threads.

Stop means on the cap 4 and container neck 5 restrict the axial movement of the cap 4 between lowered and raised positions as illustrated respectively in FIGS. 4 and 5. The preferred lowered stop means comprises an annular bead 8 on the neck 5. An internal annular flange 10 on the cap 4 engages bead 8 in the lowered cap position of FIG. 4. The preferred raised stop means when cap 4 is in the raised position, as shown in FIG. 5, comprises internal thread 7 on cap 4 and external thread 6 on neck 5. FIG. 2 illustrates a sealing fin 11 on the cap 4 for sealingly closing the neck 5 when the cap 4 is fully threaded thereon. An annular ringlike sealing bead 12 on the cap 4 adjacent the fin 11 further insures the seal. FIG. 5 illustrates an adequate contact between the cap 4 and neck 5 in the cap raised position formed by the rim 13 of the neck 5 and the cap 4 threads 7.

In accordance with the present invention there is provided flotation means on the cap 4, defining an open float chamber 14 when the cap 4 is inverted and immersed in the liquid of a flush tank for automatically shifting the cap 4 from its lowered position (FIG. 4) to its raised position (FIG. 5) in response to a rising level of the tank liquid 21. The said float comprises a generally cylindrical outer wall 15 extending beyond the cap 4 cover 9 as illustrated.

Figure 3:
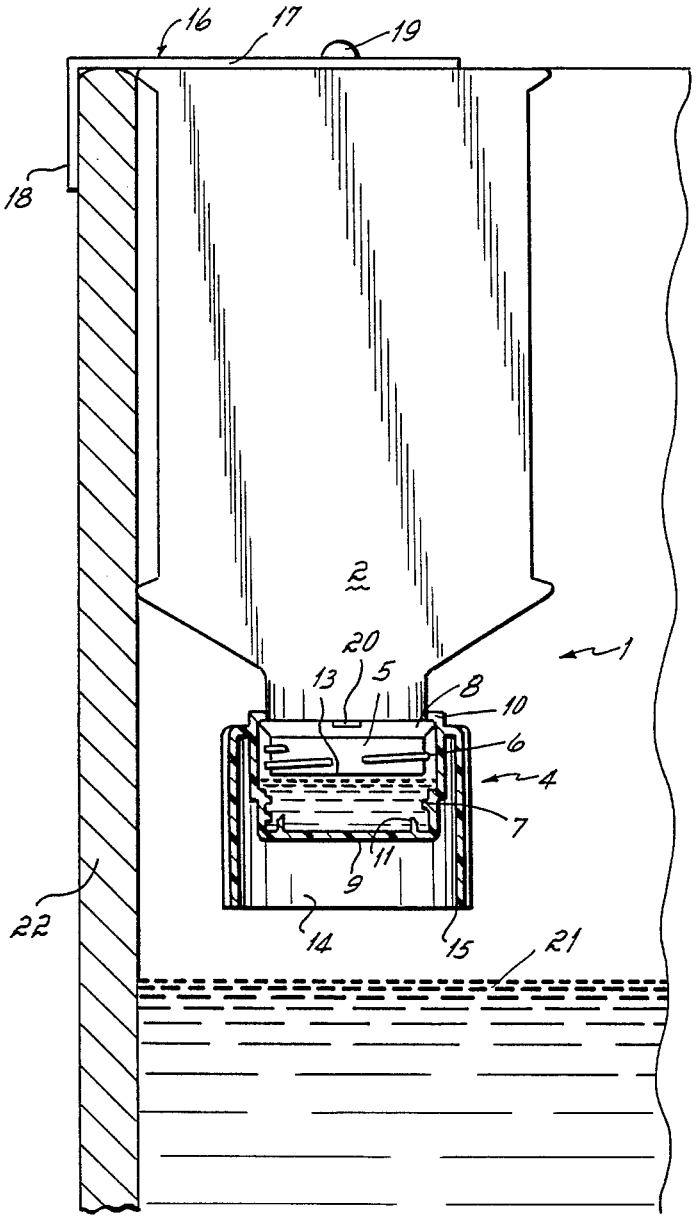
FIG. 3 is a vertical sectional view illustrating the dispenser in position in a flush tank.

A clamp 16, illustrated in FIGS. 1 and 3, having a flat body portion 17 and an angled extremity 18 is clipped or attached by a suitable metal or plastic button 19 to the container 2. The clamp 16 can be constituted of formed sheet metal or molded plastic substance. As illustrated in FIG. 3 the extremity 18 of the clamp 16 is engageable with the wall of the tank 22.

FIG. 3 illustrates a typical installation of the dispenser 1 when suspended from the wall of a flush tank 22.

The operation of the liquid dispenser 1 will now be described. The container 2 is filled with the liquid to be dispensed such as a detergent, deodorant or disinfectant. Screw cap 4 is then screwed onto the neck 5 by gently forcing the internal annular flange 10 of the cap 4 past the external screw threads 6 and annular bead 8. The neck portion 5 is preferably constituted of yieldable plastic substance, and the screw threads 6 and annular bead 8 will yield inwardly under external forces. The cap 4 is now in the position illustrated in FIG. 2. In this position, the resilient annular sealing lip 11 engages the annular sealing portion of the neck 5. The dispenser 1 may then be stored and shipped without danger of leakage with the cap 4 fully threaded onto the neck 5 as illustrated in FIG. 2.

The liquid dispenser may be installed in existing flush tanks with a minimum of time and effort. The clamp 16 is slid to the position illustrated in FIG. 3, to suspend the dispenser 1 from the wall of the flush tank 22. The dispenser 1 and captive screw cap 4 are now in an inverted position with the neck portion 5 facing downwardly. The screw cap 4 is now slowly unscrewed and the cap annular flange 10 will engage the bead 8 of the neck 5. The cap 4 will be in the position illustrated in FIG. 4 (the lowered position) and with the tank 22 empty. The flow of dispenser fluid into the cap 4 will thereupon occur until the liquid fills the cap 4. As the tank 22 fills, the cap 4 will become submerged, and the buoyancy provided by the chamber 14 will urge the cap 4 to the raised position illustrated in FIG. 5. As the cap 4 is moved from its lowered to its raised position, the liquid which heretofore filled cap 4 will become displaced by the annular walls of the neck portion 5, and thus will be forced out through the space between the cap 4 and neck portion 5. The annular bead 8 has a relieved surface comprising a plurality of flats 20 which provide passages in the form of clearance spaces between the relieved surface bead 8 and the cap 4 when the latter moves upwardly to its raised position.

It can now be understood that under normal circumstances when the flush tank 22 is full, the screw cap 4 will be submerged in the tank liquid 21, and the cap 4 will be urged to its raised position as illustrated in FIG. 5 by a buoyant force due to the captive air in the chamber 14. In the raised position, no dispensing of the container liquid occurs, since the cap threads 7 are closely engaging the neck 5. At such time as the tank liquid 21 begins to fall below the level of the raised cap 4, the cap 4 will be urged by gravity to follow the falling liquid level until the cap 4 reaches the lowered position (FIG. 4). Air from the flush tank will displace liquid from the container while liquid fills the cap 4 until the level therein reaches the level of the sealing flange 10, at which time no further liquid from the container will flow because the path of displacement air for the container is now blocked by the liquid level in the cap 4. After the tank 22 has emptied, and the liquid level therein begins to rise, the cap 4 will eventually experience a buoyant force which urges it from its lowered position (FIG. 4) to its raised position (FIG. 5). A quantity of dispensing liquid equal in volume to the quantity that entered the cap 4 during the previous transition (from the raised position to the lowered position) will be displaced from the cap 4 and travel in the spaces between relieved surfaces 20 of the bead 8. Liquid is not forced back into the container 2 during this transition because such a flow requires a net displacement of air out of the container 2, which does not occur.

From the above it is clear that liquid from the container 2 is dispensed into the tank 22 only during the movement of the cap 4 from its lowered position (FIG. 4) to its raised position (FIG. 5).

It can be seen that I have provided a novel liquid dispenser which is simple in construction, reliable in operation and can be readily installed and activated by unskilled personnel.

As various changes may be made in the form, construction and arrangement of the invention and without departing from the spirit and scope of the invention, and without sacrificing any of its advantages, it is to be understood that all matter herein is to be interpreted as illustrative and not in a limiting sense.

Having thus described my invention, I claim:

1. A liquid dispenser for flush tanks comprising the combination of:

an inverted container having a neck with external screw threads and a rim;

a cap adapted for movement on the neck and having internal screw threads cooperable and engageable with the external threads of the neck, said cap having a cover for covering said neck when said cap is fully threaded thereon;

raised and lowered stop means positioned on said cap and neck for restricting axial movement of the cap between raised and lowered positioned on the neck when the screw threads of the neck and cap are disengaged;

sealing means on the cap upstanding from said cover and cooperable with said neck for sealingly closing the neck when the cap is threaded fully thereon;

said sealing means on said cap comprises a resilient annular sealing fin which fits snugly in the open end of the container neck when said cap is fully threaded on said neck to sealingly close said neck but which is spaced from said neck when said cap is in said raised position, and an annular ring-like bead on the cap adjacent said fin which abuts said rim of said neck when said cap is fully threaded on said neck to further sealingly close said neck;

said stop means holding said sealing means away from said neck when the cap is not threaded fully onto said neck, and for enabling discharge of liquid from the container into the cap when the cap is lowered from said raised position; and flotation means on the cap for automatically shifting the cap from its lowered to its raised position in response to a rising level of said liquid in a flush tank, said flotation means comprising a generally cylindrical outer wall surrounding said cap, said outer wall having an upper end sealed to said cap to form a buoyant chamber which is closed upwardly but which opens downwardly at a lower end thereof, said cap shifting by gravity to its lowered position as the liquid level falls in the tank.

2. The liquid dispenser as claimed in claim 1 wherein said raised stop means on said cap comprises an internal thread of said cap which engages an external thread of said neck when said cap is in said raised position.

3. A liquid dispenser as claimed in claim 1, wherein:

said lowered stop means on said neck comprises an annular bead;

said bead having a relieved surface to provide for passage of liquid between the cap and neck when said cap is moving from said lowered position to said raised position.

4. A liquid dispenser as claimed in claim 3, wherein:

the relieved surface of the said bead comprises a plurality of flats thereon; and said flats providing flow passages in the form of clearance spaces between said annular bead and said cap when the latter is out of its raised position, whereby liquid from the container can flow outwardly between said neck and cap.

5. The liquid dispenser as claimed in claim 1 which further comprises a clamp for engaging a flush tank.

6. The liquid dispenser as claimed in claim 5 wherein said clamp comprises an angled end clip.

* * * * *